US006006837A

United States Patent [19]

Breit

[11] Patent Number: 6,006,837

[45] Date of Patent: Dec. 28, 1999

[54] METHOD AND APPARATUS FOR HEATING VISCOUS FLUIDS IN A WELL

[75] Inventor: Stephen M. Breit, Bartlesville, Okla.

[73] Assignee: Camco International Inc., Houston, Tex.

[21] Appl. No.: 08/971,270

[22] Filed: Nov. 17, 1997

[51] Int. Cl.[6] ..... E21B 36/04

[52] U.S. Cl. ..... 166/302; 166/60; 166/62; 166/66.4; 166/369

[58] Field of Search ..... 166/57, 60, 62, 166/65.1, 66.4, 105, 302, 369

[56] References Cited

U.S. PATENT DOCUMENTS

| | | | |
|---|---|---|---|
| 2,666,487 | 1/1954 | Bowman | 166/17 |
| 4,621,689 | 11/1986 | Brookbank | 166/106 |
| 5,070,940 | 12/1991 | Conner et al. | 166/105 X |
| 5,285,846 | 2/1994 | Mohn | 166/61 |

FOREIGN PATENT DOCUMENTS

WO91/15654 10/1991 WIPO ..... E21B 36/00

*Primary Examiner*—Roger Schoeppel
*Attorney, Agent, or Firm*—Fletcher, Yoder & Van Someren

[57] ABSTRACT

A system for heating viscous fluids in a wellbore includes a submergible pumping system comprising a pump and submergible electric motor. A heating unit is coupled to the pumping system and is supplied with electrical energy through a cable used to supply electrical energy to the motor. The heating unit may include a direct or alternating current heater and protective circuitry. The heating unit may be supplied with electrical energy through the motor stator windings or via a jumper arranged in parallel with the stator windings. Switches may be included in the heating unit and in a motor base for energizing the motor and the heating unit based upon sensed temperatures of the viscous fluids surrounding the pumping system.

28 Claims, 5 Drawing Sheets

METHOD AND APPARATUS FOR HEATING VISCOUS FLUIDS IN A WELL

BACKGROUND OF THE INVENTION

1. Field of the Invention

The present invention relates generally to a method and apparatus for heating heavy fluids to be produced from petroleum producing wells and the like. More particularly, the invention relates to a novel technique for heating fluids in the vicinity of a submergible pumping system of the type employed to produce fluids from petroleum wells.

2. Description of the Related Art

In the field of petroleum production, various techniques may be employed for raising viscous fluids, such as crude oil to the earth's surface from a wellbore. In a typical well, perforations are formed in the casing of the wellbore through which production fluids, such as crude oil, may penetrate and collect in the wellbore. Where ambient pressures are insufficient to force the fluid to the earth's surface for processing, submergible pumps are typically employed to pump production fluids up through the wellbore to collection points. Such wells and pumping arrangements may be located both on dry land and beneath bodies of water, such as over continental shelves, lakes, swamps and the like.

Known submergible pumping systems for petroleum wells typically include a pump close coupled to a submergible electric motor. A motor protector may be provided adjacent to the electric motor to protect against temperature and pressure variations in the portion of the wellbore where the submergible unit will be positioned. Inlet apertures surrounding the pump allow production fluids to flow into the pump. The electric motor drives the pump in rotation to pressurize the production fluids and to force them through a conduit to the earth's surface. Pumping units generally of this type are commercially available from Reda of Bartlesville, Okla. under the commercial designation "System 90".

While heretofore known pumping systems are generally sufficient to collect and pump many production fluids from wellbores, they may experience difficulties in handling particularly viscous or heavy fluids. Because the viscosity of such fluids is generally a function of a temperature, in certain applications heaters have been employed adjacent to submergible pumping units to preheat the fluids until their viscosity becomes sufficiently low to be pumped from the wellbore. In extreme cases, such heaters may be employed to melt solidified petroleum, paraffin waxes, hydrates and the like which can, once liquefied, be pumped via the submergible pumping system to the earth's surface.

Submergible heating systems of the type mentioned above are commonly attached to existing pumping systems including electric motor and pump sets. The heating system is powered by electrical energy transmitted through independent cables which run adjacent to the pumping system and upward through the wellbore to a power supply located at the earth's surface. Control of the heating unit is accomplished by modulating power input to the heating unit through the power supply cables. Because the heating unit is powered independently of the pumping unit, the heating unit cables are in addition to the power supply and control cables used to provide electrical energy for driving the electric motor.

While such arrangements may, in certain applications, provide adequate heating for viscous wellbore fluids, they are not without drawbacks. For example, depending upon the relative sizes of the wellbore casing and of the electric motor and pump assembly, very little clearance may be available in the wellbore for the additional power cables necessary to supply electrical energy to the heater. Similarly, the provision of multiple power cables for the heating unit and the pumping unit adds considerable cost and weight to the pumping system. Furthermore, such arrangements typically require separate power supplies and associated controls for the heating unit and the submergible electric motor. All of these factors contribute to significantly increasing the overall cost of the submergible pumping system and render the equipment more difficult to assemble, install and manage.

There is a need, therefore, for an improved technique for heating viscous fluids in a well which addresses these drawbacks of existing systems. In particular, there is a need for a submergible heating system which reduces the need for separate power supply conductors for a submergible pumping unit and a submergible heater for reducing the viscosity of fluids adjacent to the pumping unit. Ideally, such a system should be capable of implementation in both new pumping systems, and offer some degree of adaptability for retrofitting existing equipment.

SUMMARY OF THE INVENTION

The invention provides a novel technique for heating fluids adjacent to a submergible pumping unit which is designed to respond to these needs. The technique may be used in a variety of applications, but is particularly well suited to heating production fluids, such as crude oil in petroleum wells and the like. The technique employs power cables for supplying electrical energy to both an electric motor-driven submergible pumping system and to a heating system positioned in the viscous fluids. The heating system may conveniently be positioned directly adjacent to the pumping unit, such as physically below the pumping unit in the wellbore. Electrical energy supplied to the heating system through the common power supply cables heats the viscous fluids which may then be more readily pumped from the wellbore by the submergible pumping system. In a preferred configuration, the heating system includes a heating element which receives power through windings of the submergible electric motor. Both the heating system and the pumping system may be independently controlled to afford preheating of the viscous fluids prior to engaging the pumping system, as well as to heat the fluids during operation of the pumping system as the fluids are produced from the wellbore.

Thus, in accordance with a first aspect of the invention, a system is provided for heating viscous fluids in a wellbore adjacent to a submergible pumping unit. The pumping unit is of the type including a submergible electric motor having a plurality of windings. The electric motor is drivingly coupled to a pump for pumping the fluids from the wellbore. The system comprises a plurality of conductors coupled to the windings of the submergible electric motor for transmitting electrical energy to the motor. A heater element is coupled to the conductors for receiving the electrical energy through at least one of the motor windings. The heater element serves to heat the viscous fluids adjacent to the heater element. The electric motor is operative to drive the pump for displacing the heated fluids from the wellbore to the earth's surface. In a preferred configuration, a rectifier circuit is coupled to the electric motor windings for converting alternating current energy supplied to the motor to direct current energy. The heater element may then be supplied with direct current energy. Alternatively, the heater element may be supplied with alternating current energy directly through the motor windings.

In accordance with another aspect of the invention, a system is provided for producing viscous fluids from a wellbore. The system includes a submergible pump positionable within the viscous fluids, and a conduit coupled to the pump for transferring the viscous fluids from the pump. A submergible electric motor is drivingly coupled to the pump, and includes a plurality of windings. A heating unit is coupled to the electric motor for receiving electrical energy through the electric motor windings for heating the viscous fluids.

The invention also provides a system for producing viscous fluids from a wellbore that includes a pumping unit comprising a submergible pump positionable within the viscous fluids and a submergible electric motor drivingly coupled to the pump. A conduit is provided for transferring the viscous fluids from the pump. A plurality of power conductors supply electrical energy to the pumping unit for driving the electric motor. A heating unit is electrically coupled to the same power conductors for heating the viscous fluids adjacent to the pumping unit. Switching means may be provided for selectively completing and interrupting a current carrying path through the heating unit independent of operation of the electric motor.

The invention also provides a method for heating a viscous fluid in a wellbore. In accordance with the method, a submergible pumping system is positioned in the viscous fluids in the wellbore. The pumping system includes a pumping unit coupled to a heating unit. The pumping unit comprises a pump and an electric motor drivingly coupled to the pump. The electric motor has windings electrically coupled to the heating unit and to a plurality of conductors for applying electrical energy to the pumping unit. Electrical energy is applied to the heating unit through the conductors and the motor windings. In accordance with certain preferred aspects of the method, switching means may be operated to complete electrical current carrying paths between the motor windings for driving the motor, and separate current carrying paths may be selectively completed and interrupted through the heating unit.

In accordance with another aspect of the invention, a method for producing a viscous fluid from a well includes a first step of assembling a pumping system including a pump, an electric motor coupled to the pump, and a heating unit. A plurality of electrical conductors are then coupled to the electric motor and to the heating unit. At least one of the conductors is configured to apply electrical energy to both the electric motor and to the heating unit. At least the heating unit is then submerged in the viscous fluid. Electrical energy is supplied to the heating unit through the common conductor for heating the viscous fluid. The viscous fluid may then be produced by operation of the electric motor and pump.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
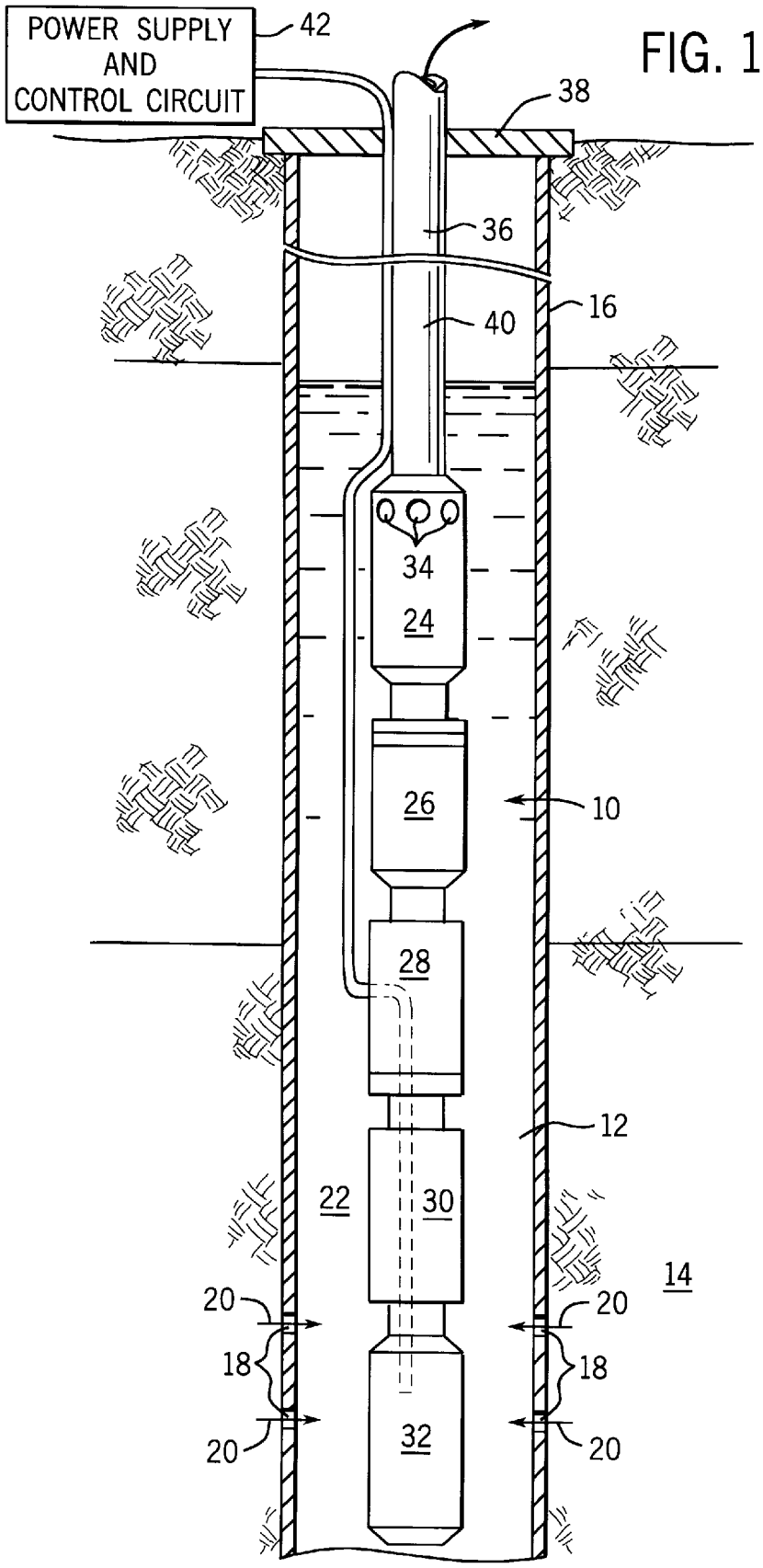
FIG. 1 is a vertical elevational view of a pumping system including a heating assembly and a pumping assembly submerged in a viscous fluid in a wellbore for heating and pumping the viscous fluids from the wellbore.

Turning now to the drawings, and referring first to FIG. 1, a pumping system, designated generally by reference numeral 10, is illustrated positioned in a wellbore 12. Pumping system 10 includes equipment for heating and for pumping viscous fluids from the wellbore as described in greater detail below. Wellbore 12 traverses a number of subterranean geological formations, including a production horizon or zone 14. In general, production zone 14 comprises geological formations containing fluids such as oil, condensate, gas, waxes, water and so forth. Wellbore 12 is bounded by a casing 16 along its length. Production perforations 18 are formed through casing 16 in the vicinity of production zone 14 to allow production fluids to enter into wellbore 12 as indicated by arrows 20 in FIG. 1. Viscous wellbore fluids, indicated generally by reference numeral 22, collect within wellbore 12 and are heated and pumped by system 10 as described below.

It should be noted that while in the illustrated embodiments pumping system 10 is shown in a vertically oriented wellbore. The present technique may be employed in vertical, inclined and horizontal wellbores, including wellbores traversing one or more production zones. Similarly, the present technique can be employed in wells having one or more discharge zones, in which certain non-production fluids are reinjected by appropriate pump assemblies.

In the embodiment illustrated in FIG. 1, system 10 includes a series of modular components assembled into a submergible unit. Thus, system 10 includes a pump 24, a motor protector 26, a motor 28, a heating unit 30 and a sensor unit 32. Pump 24 has a series of inlet openings 34 disposed about its periphery for drawing viscous wellbore fluids from the wellbore. A fluid conduit in the form of production tubing 36 is coupled to an outlet of pump 24 for transferring pumped wellbore fluids from the wellbore through a wellhead 38 to a collection point above the earth's surface. Pump 24 is driven by motor 28 through the intermediary of motor protector 26. Motor protector 26 serves to protect motor 28 from excessive temperatures and pressures which may occur within the wellbore in a manner generally known in the art.

Motor 28 is preferably a submergible electric motor. In particular, motor 28 may be a single or polyphase motor, supplied with electrical power through a multiconductor power and communication cable 40. Cable 40 extends between motor 28 and a power supply and control circuit 42 located above the earth's surface. As will be appreciated by those skilled in the art, the particular configuration of power supply and control circuit 42 will vary depending upon the size and configuration of motor 28. In general, however, where a submergible polyphase motor is used, circuit 42 will include multiphase disconnects and protection circuitry such as fuses, circuit breakers and the like. Circuit 42 may also include variable frequency drive circuits, such as voltage source inverter drives for regulating the rotational speed of motor 28 by modulation of the frequency of alternating current supplied to the motor in a manner known in the art. Drive circuitry of this type is available commercially from Reda of Bartlesville, Okla. under the commercial designation VSD. Moreover, while any suitable power conductor cable may be used for cable 40, preferred cables include multistrand insulated and jacketed cables available from Reda under the commercial designation Redahot, Redablack and Redalead.

Heating unit 30 is coupled to motor 28 and receives power through cable 40 as described in greater detail below. In general, once energized, heating unit 30 transmits thermal energy to viscous fluids 22 to raise the temperature of the viscous fluids and thereby to decrease their viscosity and facilitate their extraction from wellbore 12. Sensor unit 32 is adapted to sense temperature of the fluids in the wellbore and to transmit signals representative of the temperatures to circuit 42 or to employ such signals for control locally downhole as described below. It should be noted that while the particular configuration of pumping system 10 is described herein for exemplary purposes, the foregoing components may be assembled with additional components, depending upon the configurations of the subterranean formations and the particular needs of the well. Similarly, the foregoing and additional components may be assembled in various orders to define a pumping system which is appropriate to the particular well conditions (e.g. formation locations, pressures, casing size and so forth).

Figure 2:
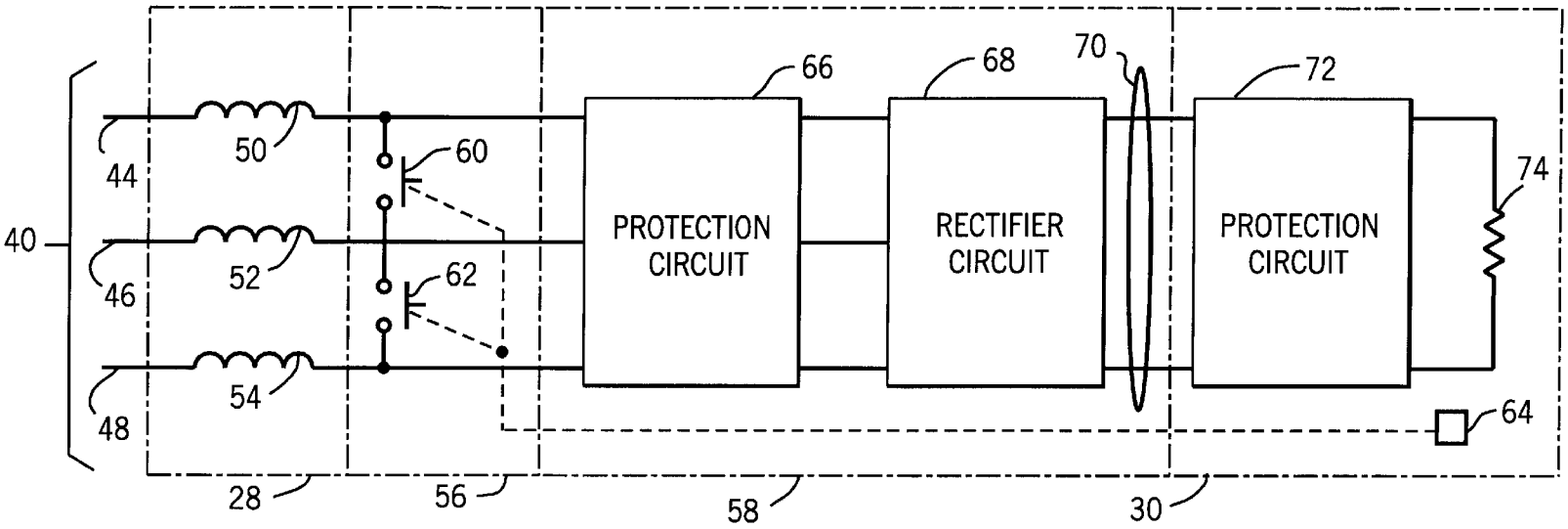
FIG. 2 is a schematic illustration of certain of the functional components of the pumping system illustrated in FIG. 1, including a submergible heating unit coupled to common conductors leading through windings of a submergible electric motor.

FIG. 2 provides a diagrammatical view of certain functional components of system 10, including a portion of motor 28, heating unit 30 and associated circuitry. As shown in FIG. 2, cable 40 includes a series of power conductors, including conductors 44, 46 and 48 for applying three-phase power to motor 28. Motor 28, in turn, includes a series of stator windings 50, 52 and 54 coupled to conductors 44, 46 and 48, respectively, for causing rotation of a rotor (not shown) within motor 28 in a manner well known in the art. As will be appreciated by those skilled in the art, stator windings 50, 52 and 54 will typically be wound and connected in groups depending upon the design of the motor stator, the number of poles in the motor, and the desired speed of the motor. A motor base 56 is provided for transmitting electrical power from motor 28 to heating unit 30 through the intermediary of a heater unit interface 58.

In the embodiment illustrated in FIG. 2, motor base 56 includes a pair of switches 60 and 62 connected across pairs of stator windings. Thus, switch 60 is configured to open and close a current carrying path between windings 50 and 52, while switch 60 is configured to open and close a current carrying path between windings 52 and 54. Switches 60 and 62 permit windings 50, 52 and 54 to be coupled in a wye configuration for driving motor 28, or uncoupled from one another when motor 28 is not driven. Switches 60 and 62 are preferably controlled by a temperature sensor 64, such as a thermistor. The preferred functionality of sensor 64 and switches 60 and 62 will be described in greater detail below.

Heater interface circuit 58 includes circuitry for limiting current through heating unit 30 and for converting electrical energy to an appropriate form for energizing unit 30. Accordingly, protection circuitry 66 will include overload devices, such as automatically resetting overcurrent or voltage relays of a type known in the art. Three-phase power from conductors 44, 46 and 48 are applied to protection circuit 66 through windings 52, 54 and 56 and, through protection circuit 66 to a rectifier circuit 68. Rectifier circuit 68, which preferably includes a three-phase full-wave rectifier, converts three-phase alternating current electrical energy to direct current energy which is output from circuit 68 via a direct current bus 70. Direct current bus 70 extends between heater interface circuit 58 and heating unit 30. Within heating unit 30, direct current bus 70 applies a direct current power to an additional protection circuit 72, preferably including protection devices of a type generally known in the art.

Heating unit 30 further includes a heater element 74 for converting electrical energy to thermal energy. While any suitable type of heater element 74 may be used in unit 30, in a presently preferred configuration, heater element 74 comprises a resistive heating element, such as a metallic coil. Alternatively, heater element 74 may comprise a metallic or ceramic block through which electrical energy is passed to raise the temperature of element 74. Thermal energy from element 74 is then transmitted to viscous fluids surrounding heating unit 30 and wellbore 12 by conduction or, where the viscous fluids are pumped past unit 30, by convection.

In the embodiment illustrated in FIG. 2, electric motor 28 may be energized to drive pump 24 by closing switches 60 and 62 in response to temperature signals received from sensor 64. Heating unit 30 will be energized both when motor 28 is driven in rotation (i.e., when switches 60 and 62 are closed) as well as motor 28 is held stationary (i.e., when switches 60 and 62 are open). This configuration is particularly suited to applications where viscous fluids require significant heating prior to driving pump 24 as well as during transfer of the fluids from the wellbore. Thus, sensor 64 will be configured to close switches 60 and 62 only when a predetermined temperature is sensed adjacent to heating unit 30.

Figure 3:
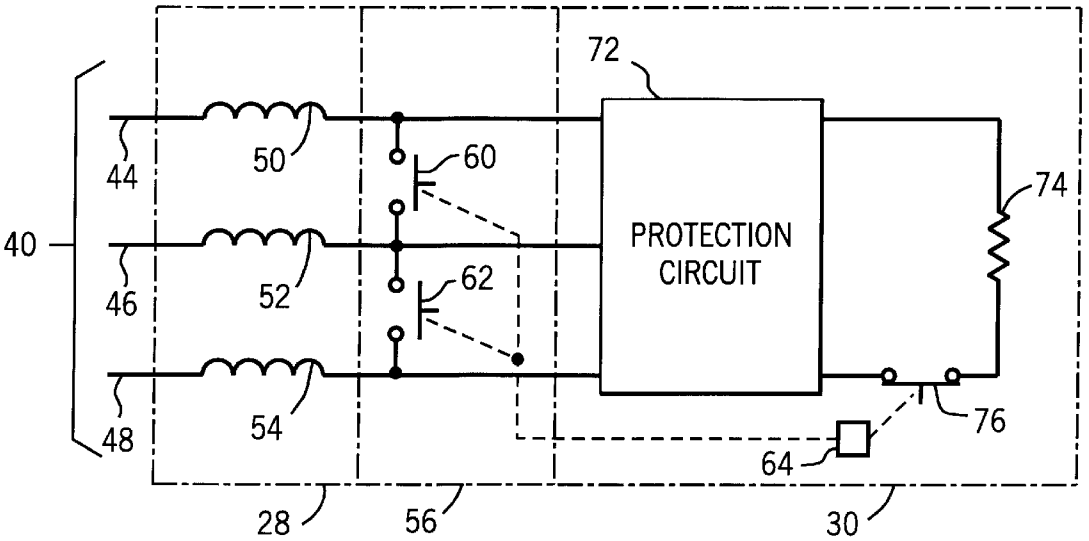
FIG. 3 is schematic view of an alternative configuration of a heating unit for use in the pumping system illustrated in FIG. 1.

FIG. 3 illustrates an alternative configuration of pump 28, motor base 56 and heating unit 30. In the embodiment illustrated in FIG. 3, heating unit 30 is configured to receive alternating current power directly from a protection circuit 72. Accordingly, alternating current power from conductors 44, 46 and 48 of cable 40 is applied to protection circuit 72 through the intermediary of stator windings 50, 52 and 54, respectively. Protection circuit 72, which preferably includes overcurrent protective devices, applies alternating current power directly to heater element 74. FIG. 3 also illustrates a feature of heating unit 30 by which a heater switch 76 is included in conductors supplying power to heater element 74. Switch 76 may be conveniently coupled to thermal sensor 64 and controlled in conjunction with switches 60 and 62 extending between stator windings 50 and 52, and between windings 52 and 54, respectively. In operation, sensor 64 is configured to open switches 60 and 62 and to close switch 76 to energize heating element 74 but to prevent rotation of motor 28 until a desired temperature is reached in viscous fluids surrounding heating unit 30. When such temperature is reached, switches 60 and 62 are closed to begin pumping viscous fluids from the wellbore. Either simultaneously with closing of switches 60 and 62, or at a predetermined higher temperature, switch 76 is opened by sensor 64 to limit temperatures of the viscous fluids surrounding the pumping system to a desired maximum temperature.

Figure 4:
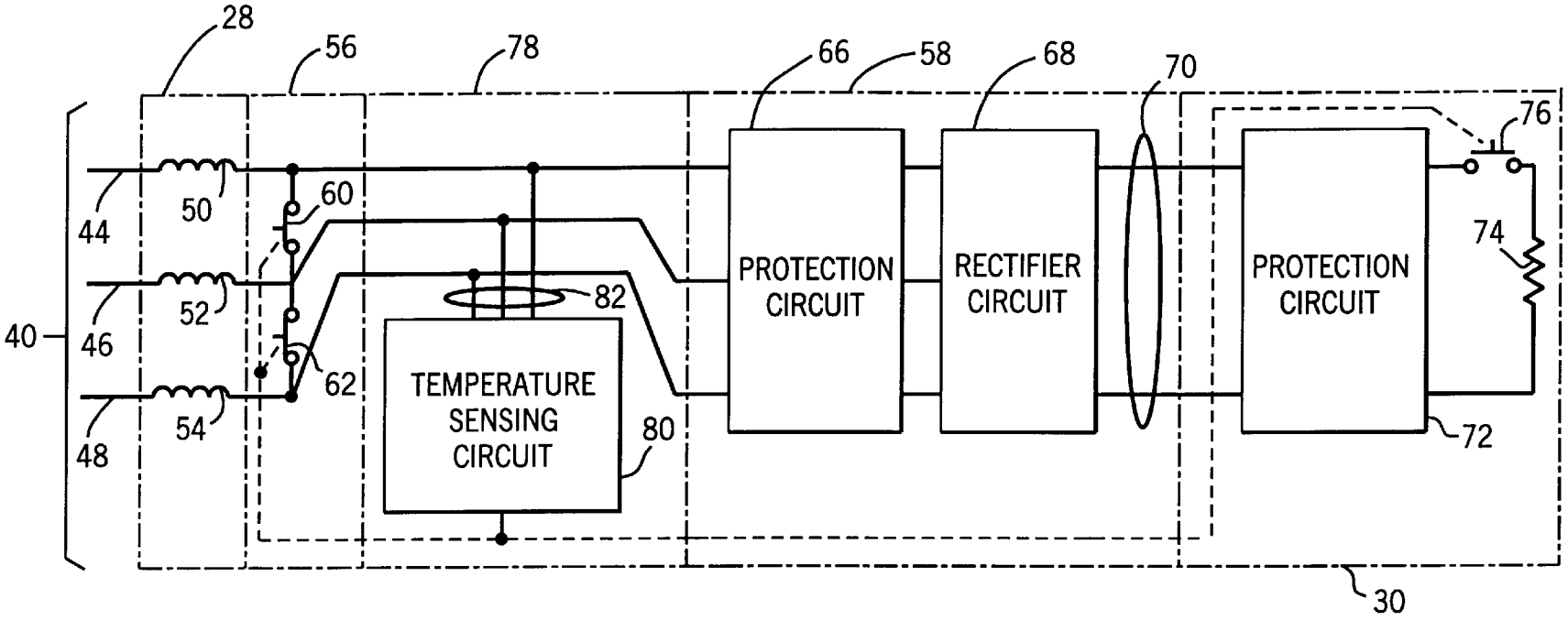
FIG. 4 is schematic illustration of a further alternative configuration of a heating unit, including a temperature sensing circuit configured for transmitting signals representative of temperature of viscous fluids in the wellbore to a position above the earth's surface.

FIG. 4 illustrates a further alternative embodiment of components of system 10, including motor 28, motor base 56, heater unit interface 58, heater 30 and a thermal sensing unit 78. In the embodiment illustrated in FIG. 4, thermal sensing unit 78, which may be substantially identical to sensor unit 32 illustrated in FIG. 1, includes a temperature sensing circuit 80. Circuit 80, which may include thermal couples or other temperature sensing devices, senses temperature adjacent to pumping system 10 and generates a signal representative of the temperature. Sensing units of this type are commercially available from Reda under the designation "PSI." Circuit 80 may also include memory circuitry for storing sensed temperatures, network circuitry for communicating the temperature signals to a remote location, and relay circuitry for commanding movement of switches 60, 62 and 76. Output conductors 82 transmit the temperature signals generated by circuit 80 to circuit 42 (see FIG. 1) and thereby to control or monitoring circuit 42 above the earth's surface via conductors 44, 46 and 48. As will be appreciated by those skilled in the art, an alternative arrangement could include a separate conductor for transmitting the temperature signals to the remote location. Similarly, temperature sensing circuit 80 may include communication circuitry for transmitting temperature signals to a remote surface location via radio telemetry. An advantage of the embodiment illustrated in FIG. 4 is the provision of a single unit 78 for controlling energization of motor 28 and heating unit 30, as well as for providing temperature signals which can be monitored by well operations personnel or equipment at the earth's surface.

It should be noted that the embodiments illustrated in FIGS. 1 through 4 offer distinct advantages over heretofore known wellbore heating systems. For example, rather than being supplied by separate power cables, heating unit 30 is energized by electrical power supplied through the same cable used to drive motor 28. It has been found that the elimination of an additional power supply cable results in substantial cost reductions as well as in a reduction in the total weight of the equipment suspended in wellbore 12. Moreover, the technique embodied in the foregoing arrangements permits heating unit 30 to be conveniently coupled to the power cable through the intermediary of motor windings 50, 52 and 54. Thus, both motor 28 and heating unit 30 may be conveniently controlled by common thermal control circuits.

Figure 5:
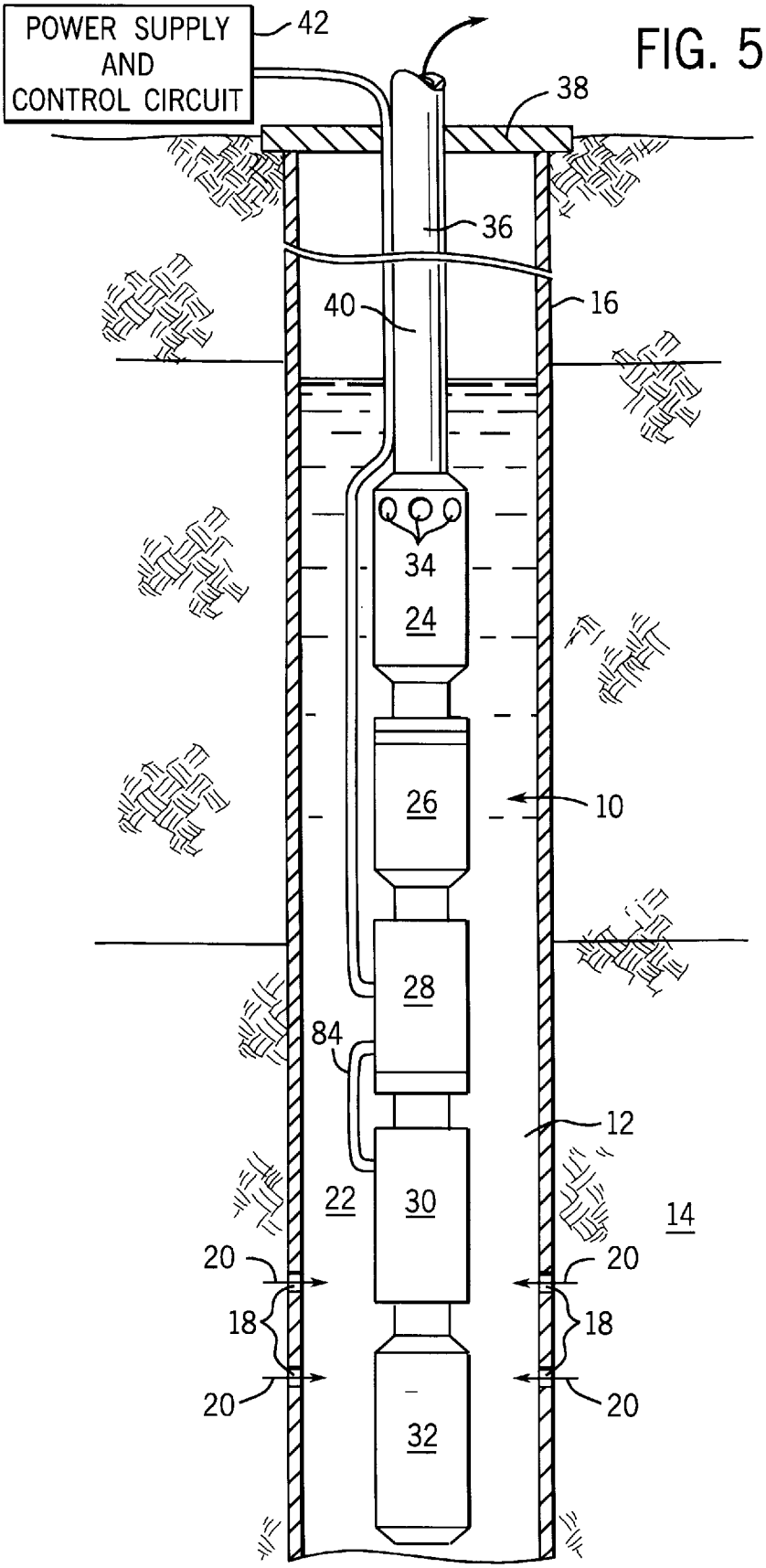
FIG. 5 is a vertical elevational view of an alternative configuration of a pumping system positioned in a wellbore for heating viscous wellbore fluids and for transferring the heated fluids from the wellbore.

FIG. 5 illustrates an alternative configuration of pumping system 10, wherein heating unit 30 is coupled to power and control cable 40 via a jumper 84 extending between motor 28 and heating unit 30. As shown in FIG. 5, the modular components of toolstring 10 may be assembled in similar order to define a heating and fluid extraction system, with heating unit 30 being effectively powered in parallel with motor 28.

Figure 6:
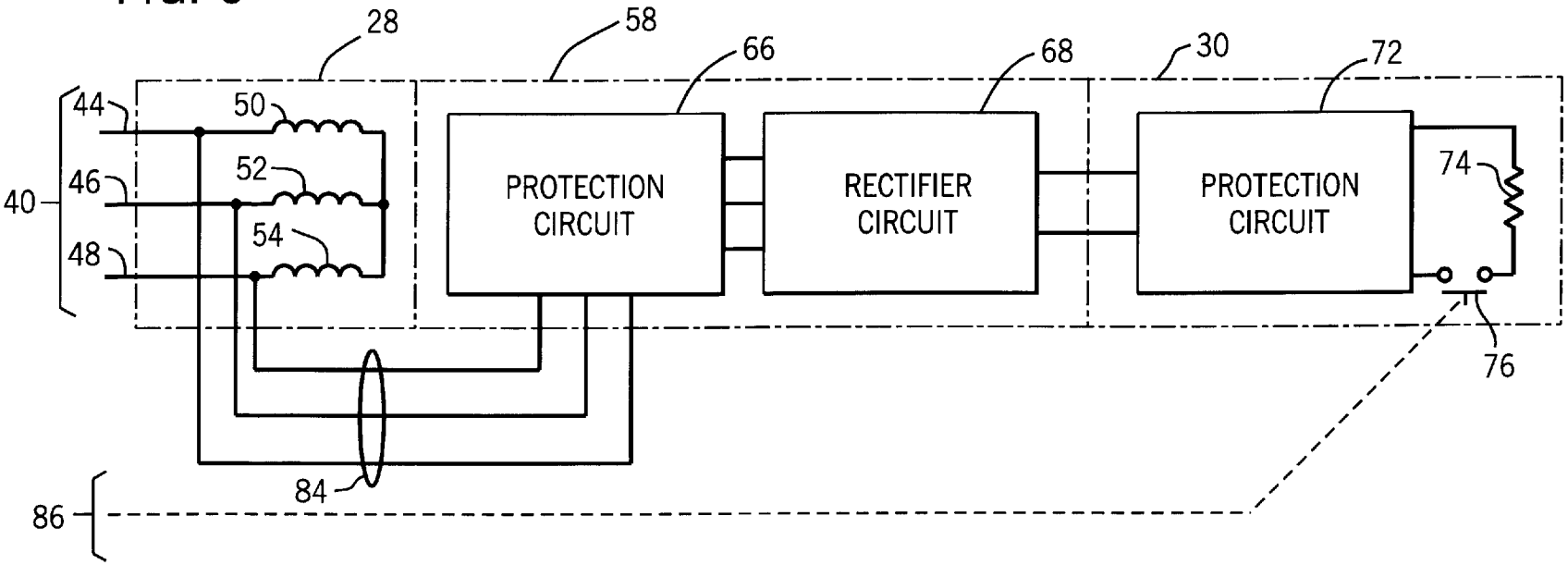
FIG. 6 is a schematic illustration of a certain of the functional components of the pumping system illustrated in FIG. 5, including a heating unit coupled to power circuitry through conductors common with an electric motor.

FIG. 6 illustrates certain of the functional circuits included in system 10 in the embodiment illustrated in FIG. 5. As shown in FIG. 6, power conductors 44, 46 and 48 are electrically coupled to stator windings 50, 52 and 54 within motor 28. Conductors 44, 46 and 48 are also coupled to jumper 84 to channel electrical energy from cable 40 to protection circuit 66 of heater interface circuit 58. As in the embodiment summarized above, protection circuit 66 preferably includes overcurrent protector devices, such as fuses or circuit breakers. Electrical energy is conducted from protection circuit 66 to rectifier circuit 68 where three-phase electrical energy is converted to direct current energy and output along a direct current bus 70. Direct current bus 70 then transmits direct current power to protection circuit 72, and therethrough to heater element 74.

FIG. 6 also illustrates an alternative configuration of the present technique wherein a heater switch 76 is controlled remotely via a data link 86. Link 86 may include a control cable or wire, or may be a radio telemetry control. As in the previous embodiments, switch 76 may also be controlled by a temperature sensor located along pumping system 10.

As will be appreciated by those skilled in the art, the features of the embodiment illustrated in FIGS. 5 and 6 offer clear advantages over existing systems. For example, rather than separate power conductors for transmitting electrical energy to heater unit 30, unit 30 is supplied with power with common cable 40 and jumper 84. Moreover, the arrangement illustrated in FIGS. 5 and 6 permits motor 28 to be controlled in a conventional manner, independently of heating unit 30. Thus, motor 28 may be energized to drive pump 24, and heater switch 76 opened and closed as desired to maintain the viscosity (or temperature) of fluids surrounding the pumping system at desired levels. It should also be noted that switches may be provided between stator windings 50, 52 and 54 in a manner similar to that described above with respect to FIGS. 2 through 4. The latter arrangement permits independent control of motor 28 and heating unit 30, without channeling electrical energy through the motor windings during energization of heating unit 30.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system for heating viscous fluids in a wellbore adjacent to a submergible pumping unit, the pumping unit including a submergible electric motor having a plurality of windings and drivingly coupled to a pump for pumping the fluids from the wellbore, the system comprising:

a plurality of conductors coupled to windings of the submergible electric motor for transmitting electrical energy to the windings; and a heater element coupled to the conductors for receiving the electrical energy through at least one of the motor windings to heat the viscous fluids adjacent to the heater element.

2. The system of claim 1, wherein the electric motor is a polyphase alternating current electric motor and the windings include stator windings for each of a plurality of power phases.

3. The system of claim 2, further comprising a rectifier circuit coupled to the stator windings for converting alternating current energy to direct current energy, wherein the rectifier circuit is coupled to the heater element for transmitting the direct current energy to the heater element through the at least one motor winding.

4. The system of claim 2, wherein the electric motor includes first, second and third stator windings and wherein the system further comprises a plurality of switching devices, a first switching device being coupled between the first and second stator windings, a second switching device being coupled between the second and third stator windings, the switching device is being operative to open and close electrical current carrying paths between the windings, whereby the heater element may receive electrical energy without the electric motor being driven in rotation.

5. The system of claim 1, further comprising an electrical switch coupled between the at least one motor winding and the heater element, the switch being operative to selectively complete and interrupt an electrical current carrying path through the heater element.

6. The system of claim 1, further comprising a temperature sensing unit coupled to the pumping unit, the temperature sensing unit configured to generate temperature signals representative of the temperature of the viscous fluids.

7. The system of claim 6, wherein the electric motor is coupled to a plurality of power conductors for supplying electrical energy from the earth's surface, and wherein the temperature signals are transmitted to the earth's surface via at least one of the power conductors.

8. A system for producing viscous fluids from a well, the system comprising:

a submergible pump positionable within the viscous fluids for pumping the viscous fluids;

a conduit for transferring the viscous fluids from the pump;

a submergible electric motor drivingly coupled to the pump, the electric motor having a plurality of windings; and a heating unit coupled to the electric motor for receiving electrical power through the electric motor windings for heating the viscous fluids.

9. The system of claim 8, wherein the electric motor is an alternating current motor, and wherein the system further comprises a rectifying circuit for converting alternating current energy to direct current energy, and conductors for transmitting direct current energy from the rectifying circuit to the heating unit.

10. The system of claim 8, further comprising means for selectively competing and interrupting electrically conductive paths between the windings.

11. The system of claim 10, wherein the heating unit is configured to receive electrical energy through the motor windings only when the motor is driven.

12. The system of claim 8, further comprising switching means coupled to the heating unit, the switching means configured to selectively energize the heating unit.

13. The system of claim 8, further comprising a temperature sensing unit configured to generate temperature signals representative of the temperature of the viscous fluids.

14. A system for producing viscous fluids from a well, the system comprising:

a pumping unit including a submergible pump positionable within the viscous fluids for pumping the viscous fluids and a submergible electric motor drivingly coupled to the pump;

a conduit for transferring the viscous fluids from the pump;

a plurality of conductors for supplying electrical energy to the pumping unit for driving the electric motor; and a heating unit electrically coupled to the conductors for heating the viscous fluids.

15. The system of claim 14, wherein the electric motor includes a plurality of stator windings electrically coupled between the conductors and the heating unit.

16. The system of claim 15, further comprising a rectifying circuit coupled to the stator windings, the rectifying circuit being configured to convert alternating current energy to direct current energy, the heating unit being coupled to the rectifying circuit for receiving the direct current energy.

17. The system of claim 15, further comprising switching means for selectively completing and interrupting a current carrying path through the heating unit.

18. The system of claim 15, further comprising a temperature sensing unit configured to sense the temperature of the viscous fluids and to generate temperature signals representative thereof.

19. The system of claim 18, wherein the temperature sensing unit is coupled to the conductors for transmitting the temperature signals to a remote location via the conductors.

20. A method for heating a viscous fluid in a wellbore, the method comprising the steps of:

(a) submerging a pumping system in the viscous fluid in the wellbore, the pumping system including a pumping unit coupled to a heating unit, the pumping unit comprising a pump and an electric motor drivingly coupled to the pump, the electric motor having windings electrically coupled to the heating unit and to a plurality of conductors for applying electrical energy to the pumping unit; and (b) applying electrical energy to the heating unit through the conductors and the motor windings.

21. The method of claim 20, wherein the pumping system includes switch means for selectively completing and interrupting current carrying paths between the motor windings, and wherein the method includes the further step of interrupting the current carrying paths between the motor windings prior to step (b).

22. The method of claim 20, wherein the pumping system includes a heater switch for selectively completing and interrupting a current carrying path through the heating unit, and wherein step (b) includes the step of closing the heater switch.

23. The method of claim 20, wherein the electric motor is an alternating current motor, and wherein step (b) includes the steps of converting alternating current energy applied to the motor windings to direct current energy, and applying the direct current energy to the heating unit.

24. The method of claim 20, wherein the pumping system includes a temperature sensor configured to generate a temperature signal representative of the temperature of the viscous fluid, and wherein the method includes the step of generating the temperature signal at least during step (b).

25. The method of claim 24, includes the further step of transmitting the temperature signal to a location remote from the pumping system via at least one of the conductors.

26. A method for producing a viscous fluid from a well, the method comprising the steps of:

(a) assembling a pumping system, the pumping system including a pumping unit, an electric motor drivingly coupled to the unit, and a heating unit;

(b) coupling a plurality of electrical conductors to the electric motor and to the heating unit, at least one of the conductors being configured to apply electrical energy to both the electric motor and to the heating unit;

(c) submerging at least the heating unit in the viscous fluid; and (d) applying electrical energy to the heating unit.

27. The method of claim 26, comprising the further step of applying electrical energy to the electric motor to pump the viscous fluid from the well.

28. The method of claim 26, wherein the electric motor includes a plurality of windings, and wherein the heating unit is coupled to the conductors through at least one of the windings.

* * * * *